US008393410B2

(12) United States Patent
Woskov et al.

(10) Patent No.: US 8,393,410 B2
(45) Date of Patent: Mar. 12, 2013

(54) MILLIMETER-WAVE DRILLING SYSTEM

(75) Inventors: Paul P. Woskov, Bedford, MA (US); Daniel R. Cohn, Cambridge, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 295 days.

(21) Appl. No.: 12/744,487

(22) PCT Filed: Dec. 17, 2008

(86) PCT No.: PCT/US2008/087191

§ 371 (c)(1),
(2), (4) Date: May 25, 2010

(87) PCT Pub. No.: WO2009/082655

PCT Pub. Date: Jul. 2, 2009

(65) Prior Publication Data

US 2010/0252324 A1 Oct. 7, 2010

Related U.S. Application Data

(60) Provisional application No. 61/045,047, filed on Apr. 15, 2008, provisional application No. 61/015,394, filed on Dec. 20, 2007.

(51) Int. Cl.
*E21B 7/14* (2006.01)

(52) U.S. Cl. ..... 175/11; 166/248

(58) Field of Classification Search ..... 175/11, 175/16

See application file for complete search history.

(56) References Cited

U.S. PATENT DOCUMENTS 3,977,478 A * 8/1976 Shuck ..... 175/16
4,090,572 A * 5/1978 Welch ..... 175/16
4,606,620 A * 8/1986 Nagano ..... 359/845
4,956,620 A * 9/1990 Moeller ..... 333/21 R
5,448,135 A * 9/1995 Simpson ..... 315/39
5,548,257 A 8/1996 Caplan et al.
6,559,742 B2 * 5/2003 Fiedziuszko et al. ..... 333/241
2002/0195247 A1 12/2002 Ciglenec et al.
2003/0121701 A1 7/2003 Polizzotti et al.
2005/0269090 A1 12/2005 Vinegar et al.
2005/0269095 A1 12/2005 Fairbanks
2006/0102343 A1 5/2006 Skinner et al.
2007/0133960 A1 6/2007 Vinegar et al.

OTHER PUBLICATIONS

PCT International Search Report, Application No. PCT/US 08/087191 Feb. 10, 2009.

J.W. Tester et al, The Future of Geothermal Power, MIT, 2006. http://geothermal.inel.gov/publications/future_of_geothermal_energy.pdf.

H. Robertson, DEA Project Summary, DEA-162, 2007. http://dea-global.org/index/projects/status/162.html.

R.B. Jurewicz, Rock Excavation with Laser Assistance, Int. J. Rock Mech. Min Sci. & Geomech. vol. 13, pp. 207-219, 1976.

R.M. Graves and D. G. O'Brien, StarWars laser technology applied to drilling and completing gas wells, Proc-SPE Annual Technical Conference and Exhibition, v Delta, Drilling and Completion, pp. 761-770, 1998.

(Continued)

*Primary Examiner* — Daniel P Stephenson
*Assistant Examiner* — Ronald Runyan
(74) *Attorney, Agent, or Firm* — Sam Pasternack; MIT Technology Licensing Office

(57) ABSTRACT

System for drilling boreholes into subsurface formations. A gyrotron injects millimeter-wave radiation energy into the borehole and pressurization apparatus is provided for pressurizing the borehole whereby a thermal melt front at the end of the borehole propagates into the subsurface formations. In another aspect, a system for fracturing a subsurface formation is disclosed.

17 Claims, 7 Drawing Sheets

OTHER PUBLICATIONS

Z. Xu, C.B. Reed, R.A. Parker, R. Graves, "Laser spallation of rocks for oil well drilling," Proceedings of 23rd International Congress on Applications of Laser & Electro-Optics, San Francisco, California, Oct. 4-7, 2004.
The Engineering Tool Box, http://www.engineeringtoolbox.com/young-modulus-d_417.html.
O. Katz, Z. Reches, J-C. Roegiers, Evaluation of mechanical rock properties using a Schmidt Hammer, International Journal of Rock Mechanics and Mining Science vol. 37, pp. 723-728, 2000.
P.P. Woskov and S.K. Sundaram, "Thermal return reflection method for resolving emissivity and temperature in radiometric methods", J. Appl. Phys., vol. 92, 6302-6310, Dec. 2002.
P.P, Woskov, K. Hadidi, P. Thomas, K. Green, and G.J. Flores, "Accurate and sensitive metals emissions monitoring with an atmospheric microwave-plasma having a real-time span calibration", Waste Management, vol. 20, 395-403, 2000.
L. Rebuffi and J.P. Crenn, "Radiation Patterns of the HE11 mode and Gaussian Approximations", International Journal of Infrared and Millimeter-Waves, vol. 9, pp. 291-310, 1998.
J.F. Stebbins, I.S.E. Carmichael, and L.K. Moret, "Heat capacities and entropies of silicate liquids and glasses", Contributions to Mineralogy and Petrology, vol. 86, pp. 131-148, 1984.
A. Navrotsky, "Thermodynamic Properties of Minerals", Mineral Physics and Crystallography, pp. 18-27, 1995.
L.L. Frach, S.J. Mclean, and R.G. Olsen, "Electromagnetic Properties of Dry and Water Saturated Basalt Rock, 1-110 GHz", IEEE Trans. Geosoi. and remote Sensing, vol. 36, pp. 754-766, 1998.
K. Petrini and Yu. Podladchinkov, "Lithospheric pressure-depth relationship in compressive regions of thickened crust", J. Metramorphic Geol., vol. 18, pp. 67-77, 2000.
P. Richet, "Viscosity and configurational entopy of silicate melts", Geochimica at Cosmochimica Acts, vol. 48, pp. 471-483, 1984.
B.C. Gahan, "Laser Drilling: Understanding Laser/Rock Interaction Fundamentals", Gas TIPS, 4-8, Spring 2002. http://media.godashboard.com/gti/4ReportsPubs/4_7GasTips/Springs02/Laser-Drilling.pdf.
K. Sakamoto, A. Kasugai, K. Takahashi, R. Minami, N. Kobayashi, and K. Kajiwara, "Achievement of robust high efficiency 1 MW oscillation in the hard-self excited region by a 170 GHz continuous-wave gyrotron", Nature Physics, vol. 3, 411-414, Jun. 2007.
E.M. Choi, C.D, Marchewka, I. Mastovsky, J.R. Sirigiri, M.A. Shapiro, R.J. Temkin, "Experimental results for a 1.5 MW, 110 GHz gyrotron oscillator with reduced mode competition", Physics of Plasmas, vol. 13, 23103-1-7, 2006.
T.L. Grimm, K.E. Kreischer, and R.J. Temkin, "Experimental study of megawatt 200-300 GHz gyrotron oscillator", Phys. Fluids B, vol. 5, 4135-4143, 1993.
A. Black and A. Judis, http://www.osti.gov/bridge/servlets/purl/875680-GOqAVP/875680.PDF.
Spears & Assosiates, Inc., initial Market Evaluation, http://www.fosssil.energy.gov/programs/oilgas/microhole/microholemarket-eval.pdf.
Glintir, http://www.glitnir.is/English/Business/Energy/USReport/.
E. A. J. Marcatili et al., "Hollow Metalic and Dielectric Waveguides for Long Distance Optical Transmission and Lasers", The Bell System Technical Journal, vol. 43, 1783-1809, 1964.
P. P. Woskov et al., "Field Test Millimeter—Wave Glass Monitoring Technology for Viscosity and Salt-Layer Formation", Transactions of the American Nuclear Society, vol. 91, 478-480, 2004.
W.C. Maurer, Novel Drilling Techniques, Pergamon Press, London, pp. 7-8, 1968.
H.K. Hellwege, ed., Landolt-Borstein Numerical data and Functional Relationships in Science and Technology, vol. 1, subvol. A, section 4.1, 1982.
R.S. Carmichael, ed., Practical handbook of Physical Properties of Rocks and Minerals, CRC Press, Boca Raton, Florida, p. 66, 1989.
Western US basalt, H.D. Holland et al., Treatise on Geochemistry, vol. 3, p. 101, 2004.
H.K. Hellwege, ed., Landolt-Borstein Numerical data and Functional Relationships in Science and Technology, vol. 1, subvol. A, section 4.3, 1982.
L.D. Landau et al., Fluid Mechanics, 2nd edit, Butterworth Heinemann, Burlington, MA, p. 5, 1987.
Z. Xu et al., "Specific energy for pulsed laser rock drilling", J. Laser applications, vol. 15, pp. 25-30, 2003.
K.H. Leong et al., "Laser and Beam Delivery for Rock Drilling", Report ANL/TD/TM03-01, Argonne National Laboratory, 35 pages, 2003.
Average Granite Composition, http://en.wikipedia.org/wiki/Granite.
W.C. Maurer, Novel Drilling Techniques, Pergamon Press, London, pp. 87-91, 1968.
D. K. Northstrom et al., Geochemical Thermodynamics, Chap. 2, The Benjamin/Cummings Publishing Co., Menlo Park, CA, 1985.
Nikolaevskiy et al., "Earth crust structure as a result of rock fracturing at high pressure and temperature conditions", in Coupled Thermo-Hydro-Mechanical Chemical Processes in Geo-Systems, O. Stephansson, J. A. Hudson, and L. Jing, eds., pp. 727-732, Elsevier, Amsterdam, 2003.
J. L. Doane, "Propagation and Mode Coupling in Corrugated and Smooth-Walled Circular Waveguides", Infrared and Millimeter Waves, vol. 13, chap. 5,K. J. Button Ed., Academic Press, New York, 1985.

* cited by examiner

Cross Section

MILLIMETER-WAVE DRILLING SYSTEM

This application claims priority to U.S. provisional application Ser. No. 61/015,394, filed Dec. 20, 2007, the contents of which are incorporated herein by reference.

BACKGROUND OF THE INVENTION

This invention relates to system for drilling and fracturing subsurface formations and more particularly to such a system using millimeter-wave radiation energy.

There is a recognized need for a better technology for deep drilling into subsurface formations to access, for example, new sources of gas, oil and geothermal energy. Drilling at depths beyond 25,000 feet is increasingly difficult and costly using present rotary drilling methods.

Current rotary drilling technology is a slow grinding and fluid flushing process that has been in use for over 100 years. This drilling process is further slowed by the need to frequently withdraw the drill to replace drill bits, casing/cementing, and to make diagnostic measurements of the borehole, accounting for up to 50% of the drill time. Furthermore, drilling to penetration depths beyond 25,000 feet (7,620 m) can be extremely difficult and costly because of increasing temperature, pressure and decreasing mechanical torque efficiencies with increasing depth. Advances in ground boring technology over this current state of the art are needed to make access into the earth's subsurface easier, deeper, and less costly.

It is also recognized that fracturing is required in many deep underground formations to extend borehole access to deep underground energy sources, for example. It is a key element in enhanced geothermal systems to make possible the circulation of injected water into hot dry rock between injection and production wells to extract heat. Fracturing is also necessary to extract natural gas and petroleum from tight formations that are being increasingly accessed to meet growing energy demands. Currently there is a large market to stimulate natural gas and petroleum reservoirs using hydraulic fracturing.

Hydraulic fracturing, known in the prior art, uses a fluid under high pressure to cause fractures to open in subsurface strata. The maximum pressure that can be obtained is limited by the mechanical pumps used to pump the fluid. Getting at increasingly deeper and tighter formations is constrained by available mechanical pumping technology. In addition, large volumes of fluid are normally required. A typical fluid is water with chemical additives optimized for fracturing. This fluid is a source of pollution that can contaminate underground drinking water sources and surface areas when it is pumped out into surface reservoirs. Thus the fluid is a significant detrimental environmental issue for many locations that can prevent exploitation of some energy formations.

It is therefore an object of the present invention to provide technology for deep drilling and fracturing of subsurface formations. The approach disclosed herein can potentially increase the penetration rate for deep drilling by a factor of 10 to 100.

SUMMARY OF THE INVENTION

In one aspect, the system for drilling boreholes into subsurface formations according to the invention includes a gyrotron for injecting millimeter-wave radiation energy into a borehole and pressurization apparatus for pressurizing the borehole such that a thermal melt front at the end of the borehole propagates into the subsurface formations. It is preferred that the millimeter-wave radiation energy is in the frequency range of 30 to 300 GHz. It is preferred that the borehole be pressurized by a combination of the pressurization apparatus and by volatilized material in the borehole.

In a preferred embodiment of this aspect of the invention, a waveguide extends into the borehole. In one embodiment, the waveguide is corrugated with circumferential grooves having a spacing and depth dependent on the millimeter-wave energy wavelength. In an embodiment, there are approximately three circumferential grooves per wavelength and the grooves have a depth of approximately one-quarter wavelength. In a preferred embodiment, the waveguide is metallic. In yet another embodiment, a mirror is provided to allow substantially horizontal drilling. The mirror may be water cooled.

In another aspect, the invention is a method and system for fracturing a subsurface formation. This aspect of the invention includes establishing a borehole extending to the subsurface formation and introducing a fluid into the borehole. A beam of millimeter-wave radiation energy is transmitted into the borehole to heat the fluid and to convert the fluid into a high pressure gas or super fluid that fractures the subsurface formation. In a preferred embodiment the radiation transmission is continuous to maintain a steady, high pressure. Alternatively, the radiation may be transmitted in a pulsed fashion to achieve high peak impulses to propagate fractures. In a preferred embodiment, a waveguide in the borehole is provided to transmit the millimeter-wave beam separate from delivery of the fluid. The energy beam and fluid may be combined at a location at which the pressure causes fracturing. The pulse width and repetition rate of the energy beam and the fluid flow volume are selected to optimize fracturing.

DESCRIPTION OF THE PREFERRED EMBODIMENTS

The millimeter wave drilling system disclosed herein uses an intense beam of millimeter-wave electromagnetic energy in combination with pressure to thermally make a path through solid strata. The millimeter wave power is preferably provided by gyrotron technology. Gyrotron technology is a high power source of millimeter-wave radiation in the frequency range of approximately 30-300 GHz. These frequencies are 10 to 100 times higher than microwave frequencies. Gyrotron CW output power levels of 1 MW have been achieved at 110 and 170 GHz as part of the international fusion energy development program with electrical to millimeter-wave power conversion efficiencies of over 50% [2, 3]. Numbers in square brackets refer to the references appended hereto. The contents of all of these references are incorporated herein by reference. One megawatt output between 200 and 300 GHz has also been demonstrated in short pulse operation in modes that could be used for CW operation [4]. Millimeter wavelengths are ideally suited for making boreholes because they are long enough to propagate through visibly obscured paths without scattering or absorption losses, but short enough to be easily localized for spot heating.

Moreover, borehole diameters in the 4 to 12 inch (10-30 cm) range are well suited to serve as waveguides to guide millimeter-wave beams over long distances. Thus the borehole acts as a guide to propagate the high power beam to greater depths as it is created. In addition, millimeter-wave diagnostics at frequencies offset from the high power beam can be superimposed on the drilling beam to monitor temperature, rate of penetration, and quality of the borehole in real time, providing information for control of the penetration process.

Figure 1:
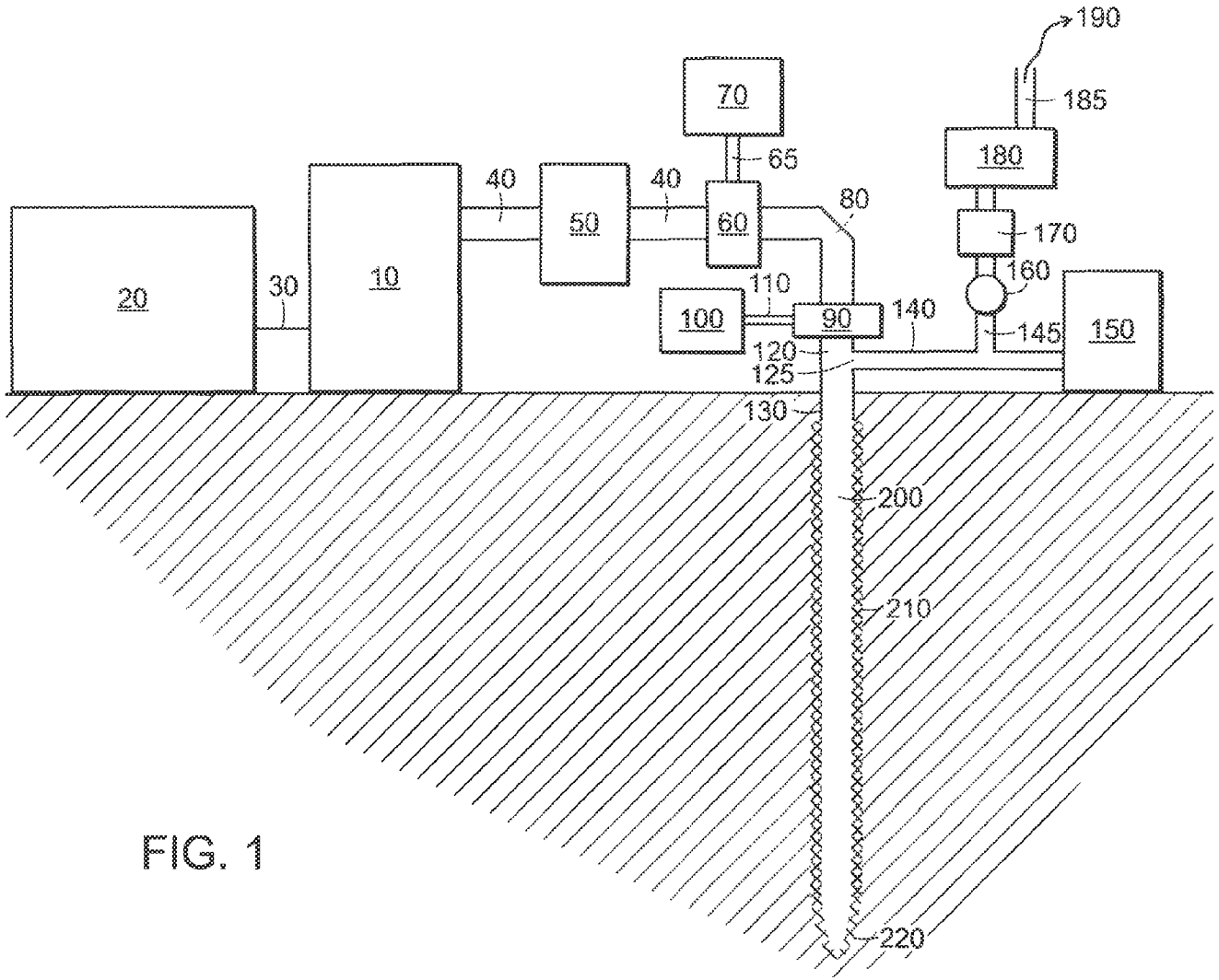
FIG. 1 is a schematic illustration of an embodiment of a gyrotron ground borer system disclosed herein.

The basic elements a of a gyrotron earth penetrator system are shown in FIG. 1. The gyrotron 10 is powered by a power supply 20 connected by a power cable 30. The high power millimeter-wave beam output of the gyrotron is guided by a waveguide 40 which has a waveguide bend 80, a window 90 to pressure seal the waveguide, and a ground inserted waveguide section 120 with opening 125 for off gas emission and pressure control. A section of the waveguide is below ground 130 to help seal the borehole.

As part of the waveguide transmission line 40 there is an isolator 50 to prevent reflected power from returning to the gyrotron and an interface for diagnostic access 60. The diagnostic access is connected to the diagnostics electronics and data acquisition 70 by low power waveguide 65. At the window 90 there is a pressurized gas supply unit 100 connected by plumbing 110 to the window to inject a clean gas flow across the inside window surface to prevent window deposits. A second, pressurization unit 150 is connected by plumbing 140 to the waveguide opening 125 to help control the pressure in the borehole 200 and to introduce and remove borehole gases as needed. The window gas injection unit 100 is operated at a slightly higher pressure relative to the borehole pressure unit 150 to maintain a gas flow across the window surface. A branch line 145 in the borehole pressurization plumbing 140 is connected to a pressure relief valve 160 to allow exhaust of volatilized borehole material and window gas through a gas analysis monitoring unit 170 followed by a gas filter 180 and exhaust duct 185 into the atmosphere 190.

Pressure in the borehole is increased in part or in whole by the partial volatilization of the subsurface material being melted. A thermal melt front 220 at the end of the borehole 200 is propagated into the subsurface strata under the combined action of the millimeter-wave power and gas pressure leaving behind a glassy/ceramic borehole wall 210. This wall acts as a dielectric waveguide to transmit the millimeter-wave beam to the thermal front 220.

An approximate estimate of the rate of penetration that is possible with the millimeter-wave beam drill can be made by using the known high temperature heat capacity of silicon dioxide ($SiO_2$), a major constituent of sandstone, shale, and granite. Assuming a 1 MW beam of energy completely absorbed by a 6 inch (15 cm) diameter column of $SiO_2$ and a temperature averaged heat capacity of 1150 Joules/kg ° C. it would take about 110 seconds to heat a 1 meter column from 20° C. (68° F.) to an average temperature 2000° C. (3630° F.), which is about 280° C. above the melting temperature of $SiO_2$. Since the gyrotron beam profile is peaked on center with a profile that has a Gaussian function, the heating on the axis of the beam will be more intense than around the circumference of the bore diameter. Axial material will be volatilized creating a pressure to force the remaining melt material forward and into the sides making dense glassy walls while removing some of the material as off gas.

The high pressure also facilitates the absorption efficiency of intense millimeter-wave energy by the melt front. The plasma break down threshold would be increased with pressure allowing more intense energy to be used for melting and volatilization without plasma creation that could reduce the direct energy coupling to the surface. It would also deform the melt front into a conical cavity for trapping reflections for more complete absorption.

Surrounding underground strata may also be fractured due to the intense thermal stresses, which would facilitate displacement of the molten material from the borehole clearance path. The molten rock that was not removed by volatilization would be a super heated, low viscosity fluid that would be displaced into the surrounding strata rather than removed as in current drilling approaches. For this simplified example the rate of penetration (ROP) would be about 105 feet (32 m) per hour, 3-5 times faster than conventional rotary drilling at depths less than 10,000 ft (3.0 km), and 10-100 times faster at depths greater than 10,000 ft (3.0 km). There would be no need to stop for replacing drills, inserting casing, or to do borehole diagnostics since this would be accomplished in real time. The chemistry of the borehole and the location depth of valuable energy resources would be identified in real time by the off gas analysis unit.

Figure 2A:
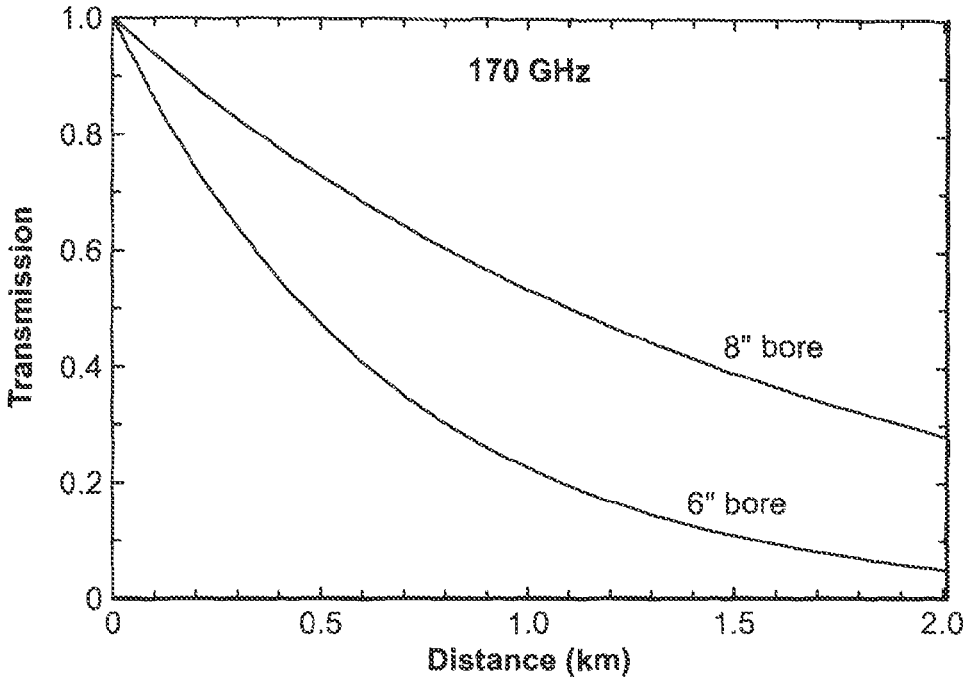
FIGS. 2*a* and 2*b* are graphs of transmission against distance for millimeter-wave beam transmission at 170 and 280 GHz into boreholes.
Figure 2B:
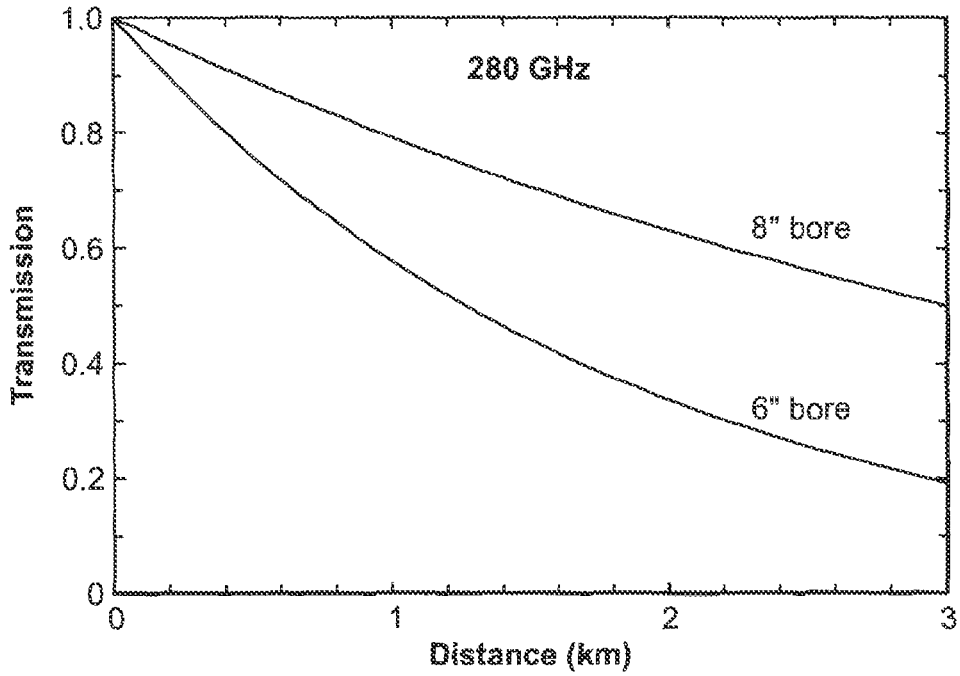

In actual practice the ROP will vary from this idealized example depending on the exact composition of the borehole material, the water content, and gyrotron beam transmission losses. The transmission losses in particular would determine how quickly the rate of penetration would fall off with distance. In waveguides with diameters larger than the wavelength, the transmission losses can be calculated for the most efficient mode of propagation ($HE_{11}$) by well known theory [5]. The transmission attenuation factor deceases inversely as the cube of borehole diameter ($1/D^3$) and inversely as the square of the frequency ($1/f^2$). However, there are limits to maximum borehole diameter because the power density would decrease due to the larger beam area, reducing the initial penetration rate, and the maximum frequency is limited to about 300 GHz by present megawatt gyrotron technology. Calculated transmission curves for two nonconducting glassy/ceramic wall borehole sizes and two gyrotron frequencies with an assumed wall dielectric constant of 2 are shown in FIGS. 2*a* and 2*b*. The transmission factor for 6 inch (15 cm) and 8 inch (20 cm) diameter boreholes as a function of distance into the borehole for the 170 GHz gyrotron frequency is shown in FIG. 2*a* and for 280 GHz in FIG. 2*b*. Transmission at 170 GHz would decrease to 50% after about 1600 and 3600 ft (0.5 and 1.1 km) in 6 and 8 inch (15 and 20 cm) boreholes, respectively. At 280 GHz the 50% transmission distances would be 4300 and 9800 ft (1.3 and 3.0 km), respectively for these same boreholes.

Extremely deep boreholes can be achieved by inserting into the borehole a more efficient waveguide. Metallic waveguides are more efficient than dielectric waveguides and for a given diameter larger than two wavelengths, a metallic waveguide with an internally corrugated surface has significantly better transmission efficiency than a smooth walled waveguide [6]. For 4 inch (10 cm) diameter aluminum tubing the transmission efficiency would be 90% for 25 miles (40 km) at 170 GHz. Therefore inserting into the borehole an internally corrugated aluminum waveguide would make possible extremely deep penetration that could be used beyond present limits of rotary drilling technology.

Figure 3:
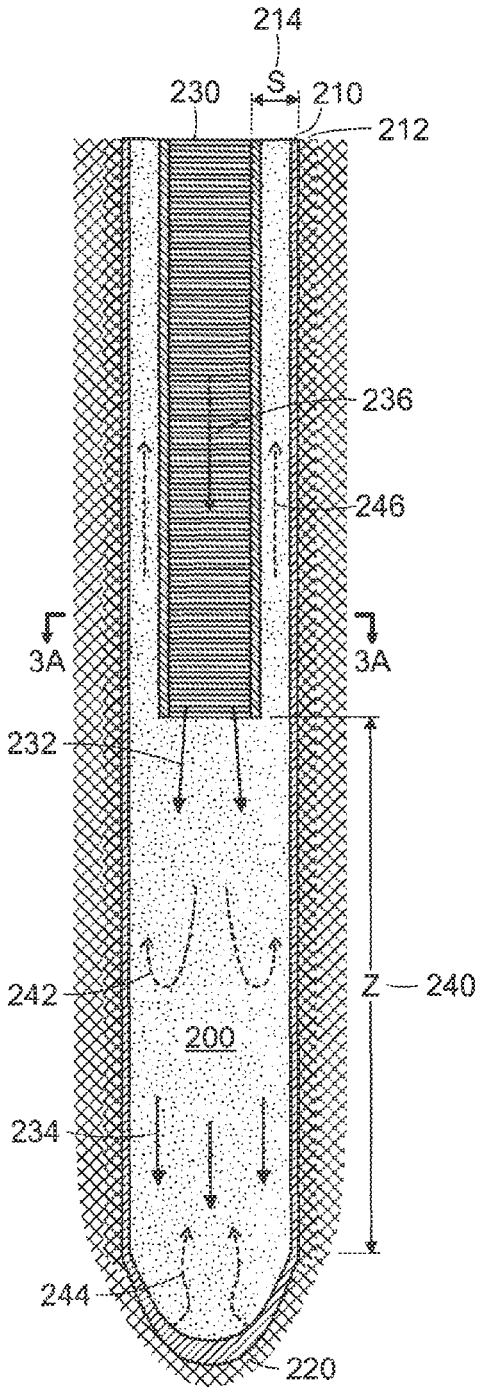
FIG. 3 is a cross-sectional view of a borehole including a metallic waveguide insertion to improve gyrotron transmission efficiency.
Figure 3A:
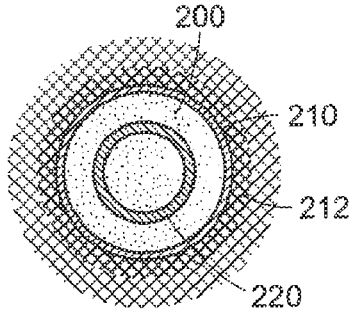

The basic elements of a borehole with an inserted waveguide for millimeter-wave transmission are shown in FIG. 3. The borehole 200 with glassy/ceramic wall 210 and permeated glass 212 has a metallic waveguide section 230 inserted to improve the efficiency of gyrotron beam propagation. The inserted waveguide diameter is smaller than the borehole diameter to create an annular gap 214 for exhaust/extraction. The stand off distance 240 of the leading edge of metallic insert waveguide from the thermal melt front 220 of the borehole is far enough to allow the launched millimeter-wave beam divergence 232 to fill 234 the dielectric borehole 200 with the guided millimeter-wave beam. The standoff distance 240 is also far enough to keep the temperature at the metallic insert low enough for survivability.

The inserted millimeter-wave waveguide also acts as a conduit for a pressurized gas flow 236 from the surface. This gas flow keeps the waveguide clean and contributes to the extraction/displacement of the rock material from the borehole. The gas flow from the surface 236 mixes 242 with the volatilized out gassing of the rock material 244 to carry the condensing rock vapor to the surface through annular space 214. The exhaust gas flow 246 is sufficiently large to limit the size of the volatilized rock fine particulates and to carry them all the way to the surface.

Figure 4:
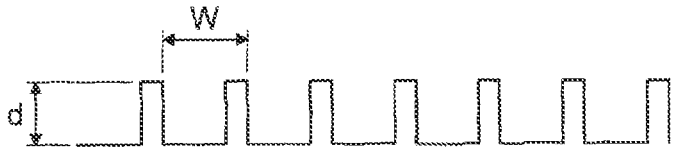
FIG. 4 is an illustration of surface corrugation inside a metallic waveguide for low loss transmission of millimeter-wave radiation.

The approximate corrugation dimensions required on the internal metallic waveguide surface for efficient transmission at 170 GHz is shown in FIG. 4. There need to be about three circumferential grooves per wavelength that are about one quarter wavelength deep. The groove could be a screw thread with a v-shaped groove. At 170 GHz a thread pitch of 40 per inch (15.7 per cm) with a groove depth of 0.017 inches (0.43 mm) would work well. At 280 GHz the optimum pitch and groove depth would be 66 per inch (26 per cm) and 0.010 inch (0.25 mm), respectively. The corrugation period "w" would be 0.023 and 0.014 inches (0.58 and 0.0.36 mm) for 170 and 280 GHZ, respectively.

Figure 5:
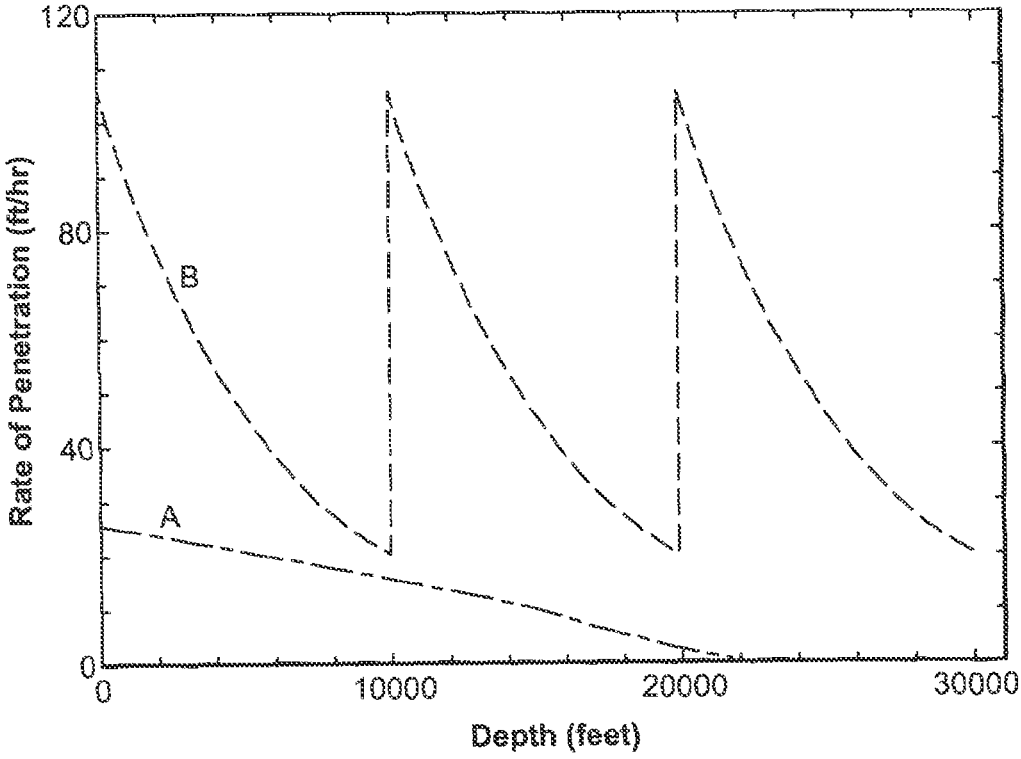
FIG. 5 is a graph of rate of penetration against depth for conventional rotary drilling and millimeter-wave beam drilling.

A comparison of the rates of penetration as a function of depth that have been achieved by conventional rotary rock drilling and those estimated for millimeter-wave beam drilling by the simplified analysis presented here is shown in FIG. 5. Curve A is a plot of the average data for rotary drilling of gas wells in the Judge Digby field in Louisiana [7]. The ROP varies from about 25 ft/hr (7.6 m/hr) near the surface to less than 2 ft/hr (0.6 m/hr) below depths of 20,000 ft (6.1 km). An estimated ROP for a 1 MW 280 GHz millimeter-wave beam is shown by curve B for a 6 inch (5 cm) diameter borehole. The ROP varies from approximately 105 ft/hr (32 m/hr) at the surface to about 20 ft/hr (6 m/hr) at a depth of 10,000 ft (3.0 km), the fall off in ROP due to the transmission losses of the millimeter-wave beam in the glassy/ceramic walled borehole. At this depth a metallic waveguide is inserted and the rate of penetration is restored back to about 105 ft/hr (32 m/hr) at the full 1 MW power level. For the next 10,000 ft (3.0 km) depth increment to 20,000 ft (6.1 km) the rate of penetration varies in the same way as for the first 10,000 ft (3.0 km) interval after which the metallic waveguide is extended to 20,000 ft (6.1 km) and the ROP restored to again about 105 ft/hr (32 m/hr). The millimeter-wave drilling is then resumed to 30,000 ft (9.1 km) and so on. This cycle of drilling and waveguide insertion can be repeated as often as necessary to reach extreme depths not possible with rotary drilling technology. The distance interval that is covered between waveguide insertions can be varied to maximize the average penetration rate and minimize cost.

Figure 6:
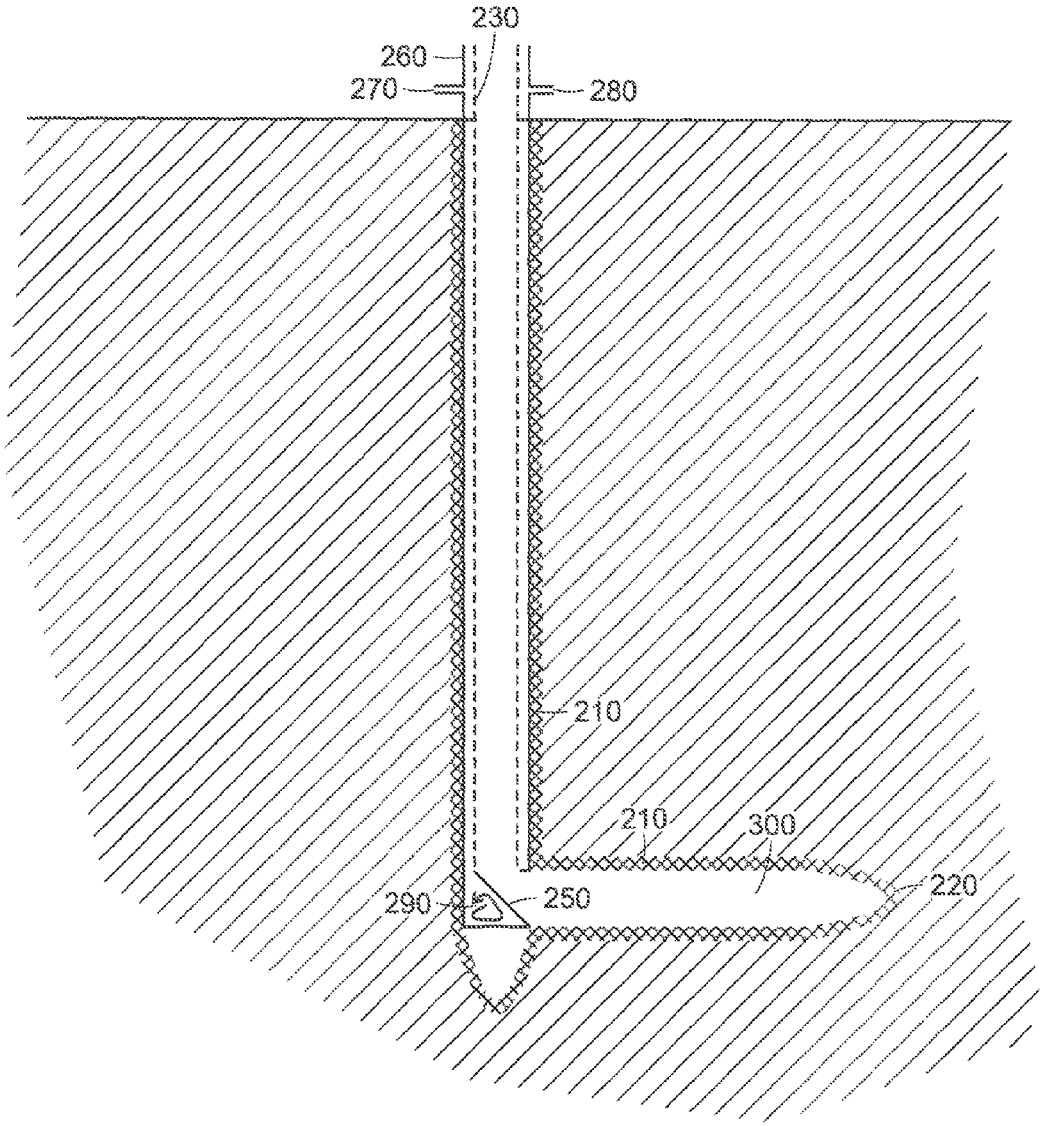
FIG. 6 is a cross-sectional view of an embodiment of the invention adapted for horizontal drilling.

The millimeter wave drilling system can be used by itself or in combination with conventional drilling. Conventional drilling can be employed where it works best. At a depth where the expense becomes prohibitory, conventional drilling could be discontinued and millimeter wave drilling could be used to extend the well depth. This approach could be carried out by placing waveguides inside the bore that was produced by conventional drilling Millimeter-wave beam drilling can also be used for horizontal drilling. When drilling vertically the beam is aimed downward by waveguide/optics at the surface and the drilling will follow this aimed direction without deviation. It is possible to change the beam direction with a special waveguide mirror system to drill horizontally or any other desired direction. The basic elements of a beam turning waveguide mirror system are shown in FIG. 6. The corrugated waveguide 230 inserted into the borehole has a turning mirror at its end 250 to change the direction of the millimeter-wave beam. The waveguide has a water jacket 260 with water input 270 and output 280 to direct a circulation of water 290 to the mirror to keep its temperature below damage levels as the drill direction of the borehole is changed. The angled borehole 300 will follow the direction set by the turning mirror. This system could also be used to make chambers in the borehole. In addition, it could also be used with short high peak power pulses, not long enough to cause melting, to fracture the glassy/ceramic wall of the original millimeter-wave drilled borehole to make it more permeable to the subsurface energy resources.

High-temperature fracturing as disclosed herein can increase the maximum pressure and fracturing that can be achieved deep underground and could reduce the volume of fluid that is needed to cause a given amount of stimulation of an energy formation. This is accomplished by transmitting an intense millimeter-wave beam of energy into the borehole to heat a working fluid and converting it into a high pressure gas or super fluid underground at the energy formation where it is needed. Operation of this high temperature fracturing technology could be either continuous to maintain a steady high pressure as in conventional hydraulic fracturing or it could be rapidly pulsed to achieve high peak impulses that would propagate fractures in a hammer like manner. A proppant in the working fluid and high average pressure would keep the fractures open between pulses to propagate the next pressure pulse to new fracturing beyond the preceding fractures. Since the high pressure is generated by a beam of energy locally in the borehole, mechanical limits for generating high pressures are removed and pressure drops for transmitting a high pressure flow long distances are circumvented. Such an approach could make it possible to access deeper and tighter energy resources with reduced environmental impacts.

Figure 7:
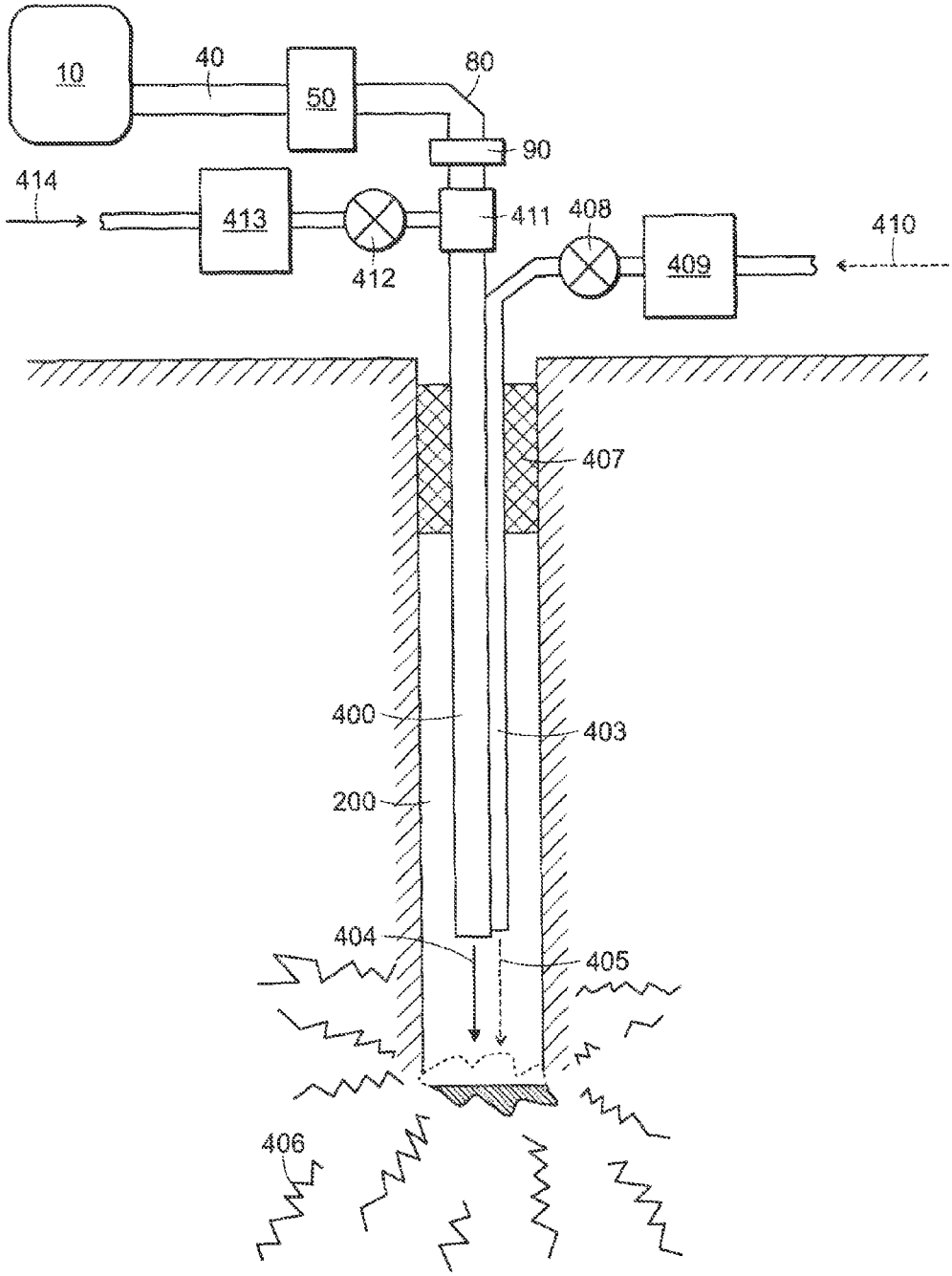
FIG. 7 is a schematic illustration of an embodiment of a high-temperature, subsurface millimeter-wave fracturing apparatus using a high power source of beam energy.

One embodiment is shown in FIG. 7. A transmission waveguide for a millimeter-wave beam of energy 400 is inserted into the borehole 200 along with a companion conduit 403 for a fluid such as water. The output millimeter-wave beam 404 and the output fluid 405 combine below the waveguide and fluid conduit to heat the fluid to a high temperature raising the pressure. For example, water could be heated to a high temperature steam or super fluid. The super heated fluid would create stress fractures 406 in the subsurface strata that would propagate away from the borehole and accept the further flow of the high pressure gas/liquid fracturing fluid to propagate the fracturing process.

A packer 407 is used to seal the borehole to the surface atmosphere to confine the high pressure thrust generated underground to propagate downward and outward into the subsurface strata. The waveguide 400 and fluid flow conduit 403 are also sealed to upward pressure flow by a window 90 in the waveguide 400 and a one way valve 408 in the fluid line 403. The fluid is pumped by a pump 409 from an outside source of fluid 410 such as water. A gas manifold 411 in the waveguide is used to introduce a waveguide purge gas flow through a second one way valve 412 from a compressor 413 from an outside source of gas 414 such as dry air. The purge gas functions as a transparent medium for propagation of the millimeter wave energy, keeping the interior surface of the waveguide clean, and displacing some of the required fluid volume for fracturing.

The high power source of energy 10 above ground such as a millimeter-wave gyrotron is connected by an above ground waveguide 40 having waveguide bends 80 as necessary to guide the energy beam to the window 90 and align it with the underground waveguide 400. An isolator 50 is incorporated into the waveguide 40 to prevent back reflections from perturbing the of the high power source of energy 10.

The main advantages of this approach over current hydraulic fracturing methods are: 1) high pressure is generated by non-mechanical means at the borehole location where it is required, making possible higher pressures at deeper locations, and 2) the volume of required fluids is reduced because higher pressure can do more work for a given fluid volume and because some of the fluid is replaced by non-polluting gas flow. Therefore, this approach would be capable of accessing more energy formations with a smaller environmental impact.

Figure 8:
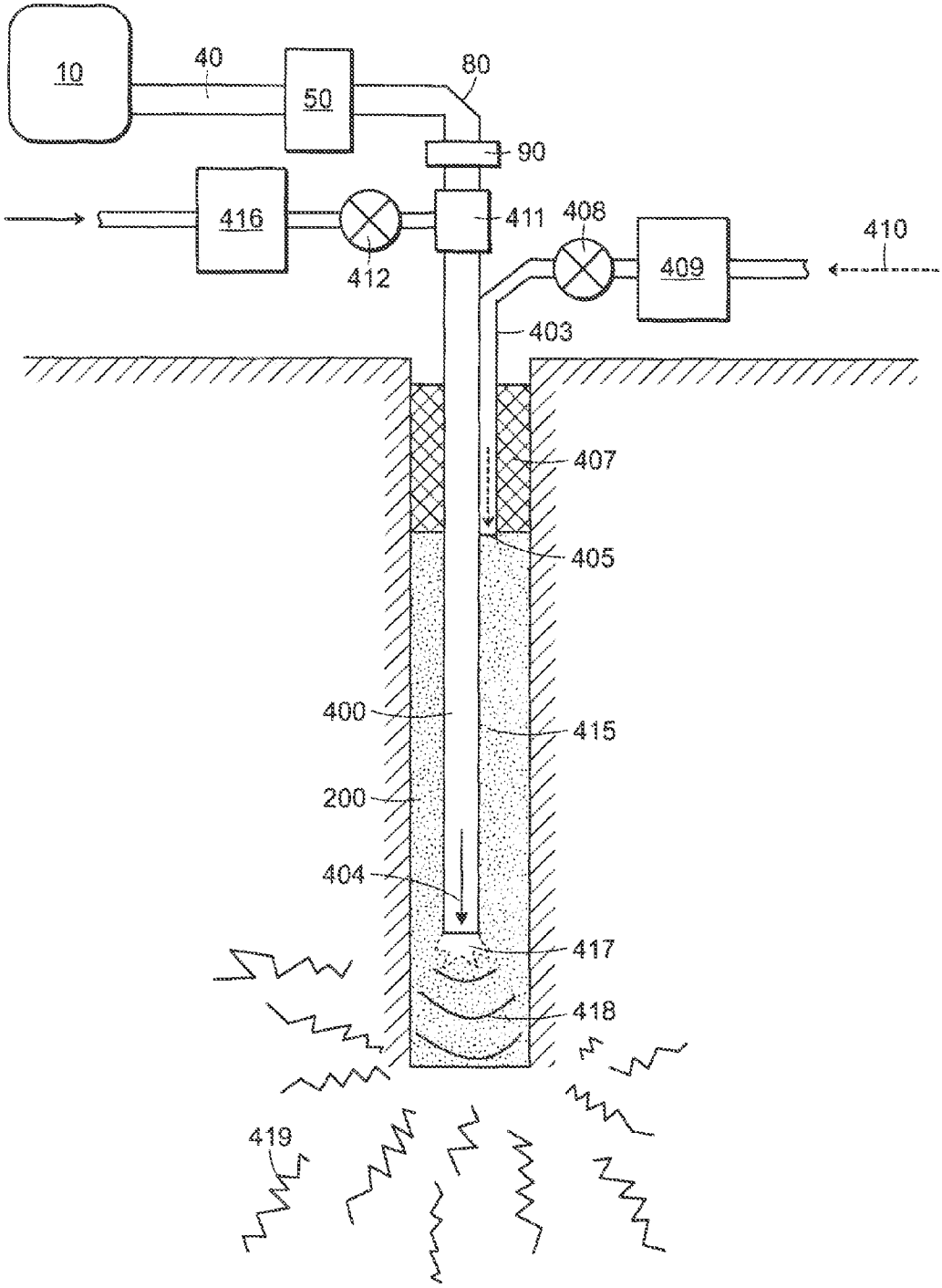
FIG. 8 is a schematic illustration of an embodiment of the invention used to augment conventional hydraulic fracturing to higher pulsed pressures.

A second embodiment is shown in FIG. 8. In this embodiment the millimeter-wave beam is used to create pressure pulses to augment conventional hydraulic fracturing. The fluid conduit 403 extends only to just beyond the borehole sealing packer 407 to fill the entire borehole 200 below the packer 407 with the hydraulic fracturing fluid 415. The millimeter-wave waveguide 400 is pressurized by a gas 414 through a compressor 416 to keep it clear of the hydraulic fracturing fluid 415. At the output aperture 417 of the waveguide the millimeter-wave beam of energy 404 is absorbed by the hydraulic fracturing fluid, resulting in the generation of a high pressure pulse 418 that propagates into the substrata to promote fracturing 419. The pulse width and repetition rate of the millimeter-wave beam can be adjusted to optimize the fracturing process.

A third embodiment is the use of millimeter wave energy for fracturing rock without the use of a fluid. High pressure pulses could be employed. The same millimeter wave system that is used for the other fracturing embodiments could be utilized. The source can be a gyrotron and the transmission system can be a corrugated waveguide. The fractured rock can be removed by various means that include but are not limited to use of a fluid.

REFERENCES

1. B. C. Gahan, "Laser Drilling: Understanding Laser/Rock Interaction Fundamentals", GasTIPS, 4-8, Spring 2002. http://media.godashboard.com/gti/4ReportsPubs/4_7GasTips/Spring02/LaserDrilling.pdf
2. K. Sakamoto, A. Kasugai, K. Takahashi, R. Minami, N. Kobayashi, and K. Kajiwara, "Achievement of robost high-efficiency 1 MW oscillation in the hard-self-excited region by a 170 GHz continuous-wave gyrotron", Nature Physics, vol. 3, 411-414, June 2007.
3. E. M. Choi, C. D. Marchewka, I. Mastovsky, J. R. Sirigiri, M. A. Shapiro, R. J. Temkin, "Experimental results for a 1.5 MW, 110 GHz gyrotron oscillator with reduced mode competition", Physics of Plasmas, vol. 13, 23103-1-7, 2006.
4. T. L. Grimm, K. E. Kreischer, and R. J. Temkin, "Experimental study of megawatt 200-300 GHz gyrotron oscillator", Phys. Fluids B, vol. 5, 4135-4143, 1993.
5. E. A. J. Marcatili and R. A. Schmeltzer, "Hollow Metalic and Dielectric Waveguides for Long Distance Optical Transmission and Lasers", The Bell System Technical Journal, vol. 43, 1783-1809, 1964.
6. J. L. Doane, "Propagation and Mode Coupling in Corrugated and Smooth-Walled Circular Waveguides", Infrared and Millimeter Waves, vol. 13, chap. 5, K. J. Button Ed., Acadamic Press, New York, 1985.
7. A. Black and A. Judis, http://www.osti.gov/bridge/servlets/purl/875680-GOqAVP/875680.PDF
8. Spears & Associates, Inc., Initial Market Evaluation, http://www.fossil.energy.gov/programs/oilgas/microhole/microholemarketeval.pdf
9. Glintir, http:www.glitnir.is/English/Business/Energy/US-Report/

What is claimed is:

1. System for drilling boreholes into subsurface formations comprising:

a gyrotron for injecting millimeter-wave radiation energy into the borehole; and pressurization apparatus for pressurizing the borehole, whereby a thermal melt front at the end of the borehole propagates into the subsurface formations.

2. The system of claim 1 wherein the millimeter-wave radiation energy is in the frequency range of 30 to 300 GHz.

3. The system of claim 1 wherein the borehole is pressurized by a combination of the pressurization apparatus and by volatilized material.

4. The system of claim 1 further including a waveguide extending into the borehole.

5. The system of claim 4 wherein the waveguide is corrugated with circumferential grooves having a spacing and depth dependent on the millimeter-wave energy wavelength.

6. The system of claim 5 wherein there are approximately three circumferential grooves per wavelength and having a depth of approximately one-quarter wavelength.

7. The system of claim 4 wherein the waveguide is metallic.

8. The system of claim 4 wherein the waveguide is spaced apart from the melt.

9. The system of claim 4 wherein the waveguide is smaller in diameter than the borehole to create an annular gap between the waveguide and borehole.

10. The system of claim 1 further including a window along with having flowing gas across the waveguide.

11. The system of claim 1 further including an isolator to prevent damage from reflected millimeter-wave radiation.

12. The system of claim 1 wherein initially the borehole is established by conventional rotary drilling to a selected depth.

13. The system of claim 1 further including a separate millimeter-wave system to provide borehole diagnostics.

14. The system of claim 1 further including a minor to provide substantially horizontal drilling.

15. The system of claim 14 wherein the mirror can be turned.

16. The system of claim 14 further including water cooling of the mirror.

17. The system of claim 1 wherein the system forms a wall of glassy material around the borehole.

* * * * *